US010643524B2

(12) United States Patent
Matsumoto

(10) Patent No.: US 10,643,524 B2
(45) Date of Patent: May 5, 2020

(54) DISPLAY DEVICE, AND METHOD OF CONTROLLING DISPLAY DEVICE

(71) Applicant: SEIKO EPSON CORPORATION, Tokyo (JP)

(72) Inventor: Morio Matsumoto, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/262,186

(22) Filed: Jan. 30, 2019

(65) Prior Publication Data

US 2019/0237004 A1 Aug. 1, 2019

(30) Foreign Application Priority Data

Jan. 31, 2018 (JP) ..... 2018-014571

(51) Int. Cl.
*G09G 3/20* (2006.01)

(52) U.S. Cl.
CPC ..... *G09G 3/2096* (2013.01); *G09G 2330/02* (2013.01); *G09G 2370/12* (2013.01)

(58) Field of Classification Search
CPC ..... G09G 3/2096; G09G 2370/12; G09G 2330/02
See application file for complete search history.

(56) References Cited

U.S. PATENT DOCUMENTS

2010/0321585 A1* 12/2010 Kurokawa ..... H04N 5/44 348/705

FOREIGN PATENT DOCUMENTS

JP 2009-296404 A * 12/2009 ..... G03B 21/00

* cited by examiner

*Primary Examiner* — Maurice L. McDowell, Jr.
*Assistant Examiner* — Donna J. Ricks
(74) *Attorney, Agent, or Firm* — Oliff PLC

(57) ABSTRACT

A projector includes a connection section to which two interface boards can be connected in a replaceable manner, a board communication section, a determination section, a power control section, and an operation receiving section adapted to receive a selection operation of the interface board, and in the state in which the power control section supplies the power to one interface board but does not supply the power to the other interface board, when the selection operation of the other interface board is received, the power control section stops supplying the power to the one interface board, and then starts supplying the power to the other interface board.

5 Claims, 4 Drawing Sheets

DISPLAY DEVICE, AND METHOD OF CONTROLLING DISPLAY DEVICE

The entire disclosure of Japanese Patent Application No. 2018-014571, filed Jan. 31, 2018 is expressly incorporated by reference herein.

BACKGROUND

1. Technical Field

The present invention relates to a display device and a method of controlling a display device.

2. Related Art

In the past, there has been known a display device having a plurality of input terminals (see, e.g., JP-A-2009-296404 (Document 1)). In Document 1, there is disclosed a projector having a plurality of input terminals to be connected to external devices, and projecting a picture input from the input terminal selected by a user in the state in which some of the input terminals are connected to the external devices.

Incidentally, there exist a plurality of types of input terminals as described in Document 1. Therefore, it is difficult for a display device to be provided with all types of input terminals due to given limitations in some cases. Therefore, it is desirable for the display device to have a configuration to which an interface board provided with the input terminal the user requests can be connected in a replaceable manner as an expansion slot of a PC. In the case of using a plurality of interface boards in this configuration, the power necessary for an operation exceeds the power which can be supplied from the display device in some cases depending on the type of the interface board. In this case, the display device fails to supply the interface boards with sufficient power, and there is a possibility that the user cannot use the interface board thus selected.

SUMMARY

An advantage of some aspects of the invention is to make it possible for the user to surely use the interface board thus selected in the display device to which a plurality of interface boards can be connected in a displaceable manner.

A display device according to an aspect of the invention includes a connection section to which a plurality of interface boards can be connected in a replaceable manner, a communication section adapted to communicate with the interface board connected to the connection section, a determination section adapted to determine a type of the interface board connected to the connection section, a power control section adapted to control supply of power to the interface board connected to the connection section, an operation receiving section adapted to receive a selection operation adapted to select any of the interface boards connected to the connection section, and a display section adapted to display an image based on image information input from the interface board selected by the selection operation to the communication section, and in a state in which the power control section supplies the power to a first interface board but does not supply the power to a second interface board connected to the connection section based on the types of the plurality of interface boards determined by the determination section, when the operation receiving section receives the selection operation of selecting the second interface board, the power control section stops supplying the power to the first interface board, and then starts supplying the power to the second interface board after stopping the supply of the power to the first interface board.

According to the aspect of the invention, it is possible to supply the sufficient power to the interface board selected by the selection operation. Therefore, it is possible to make it possible for the user to surely use the interface board selected by the user in the display device to which a plurality of interface boards can be connected in a displaceable manner.

In the aspect of the invention, the display device may further include a storage section adapted to store a combination of the types of the interface boards which cannot concurrently be supplied with the power, wherein in a case in which the combination of the types of the plurality of interface boards determined by the determination section corresponds to the combination stored in the storage section, the power control section may supply the power to the interface board selected by the selection operation, and may not supply the power to other interface boards corresponding to the combination stored in the storage section.

According to the aspect of the invention with this configuration, even in the case in which the plurality of interface boards which cannot concurrently be supplied with the power is connected, it is possible to supply the sufficient power to the interface board selected. Therefore, it is possible to make it possible to surely use the interface board selected by the user even in the case in which the plurality of interface boards which cannot concurrently be supplied with the power is connected.

In the aspect of the invention, in a case in which the combination of the types of the plurality of interface boards determined by the determination section fails to correspond to the combination stored in the storage section, the power control section may supply the power to each of the plurality of interface boards connected to the connection section.

According to the aspect of the invention with this configuration, in the case in which the plurality of interface boards which can concurrently be supplied with the power is connected, it is possible to supply the sufficient power to the plurality of interface boards including the interface board selected. Therefore, it is possible to make it possible for the user to use the plurality of interface boards including the interface board selected.

In the aspect of the invention, the display device may further include an error detection section adapted to detect an error of the interface board selected by the selection operation, and a notification section, and in a state in which the power control section supplies the power to the first interface board connected to the connection section, but does not supply the power to the second interface board, and in a case in which the error detection section has detected the error in the second interface board selected by the selection operation, the power control section may keep supplying the power to the first interface board and make the notification section give notification of the error detected by the error detection section.

According to the aspect of the invention with this configuration, in the case in which the error in the second interface board selected by the selection operation has been detected by the error detection section, since the supply of the power to the first interface board is kept and the notification section gives notification of the error detected by the error detection section, it is possible to make the user recognize the error detected in the interface board selected while preventing the expansion of the error.

Another aspect of the invention is directed to a method of controlling a display device including a connection section to which a plurality of interface boards can be connected in a replaceable manner, an operation receiving section adapted to receive a selection operation adapted to select any of the interface boards connected to the connection section, and a display section adapted to display an image based on image information input from the interface board selected by the selection operation, the method including the steps of determining a type of the interface board connected to the connection section, and stopping supply of power to a first interface board in a case of receiving the selection operation of selecting a second interface board in a state in which the power is supplied to the first interface board connected to the connection section but the power is not supplied to the second interface board based on the types of the plurality of interface boards determined, and then starting supply of the power to the second interface board after stopping the supply of the power to the first interface board.

According to the aspect of the invention, since the sufficient power can be supplied to the interface board selected by the selection operation, it is possible to make it possible to surely use the interface board selected by the user in the display device to which the plurality of interface boards can be connected in a replaceable manner.

BRIEF DESCRIPTION OF THE DRAWINGS

The invention will be described with reference to the accompanying drawings, wherein like numbers reference like elements.

DESCRIPTION OF AN EXEMPLARY EMBODIMENT

Figure 1:
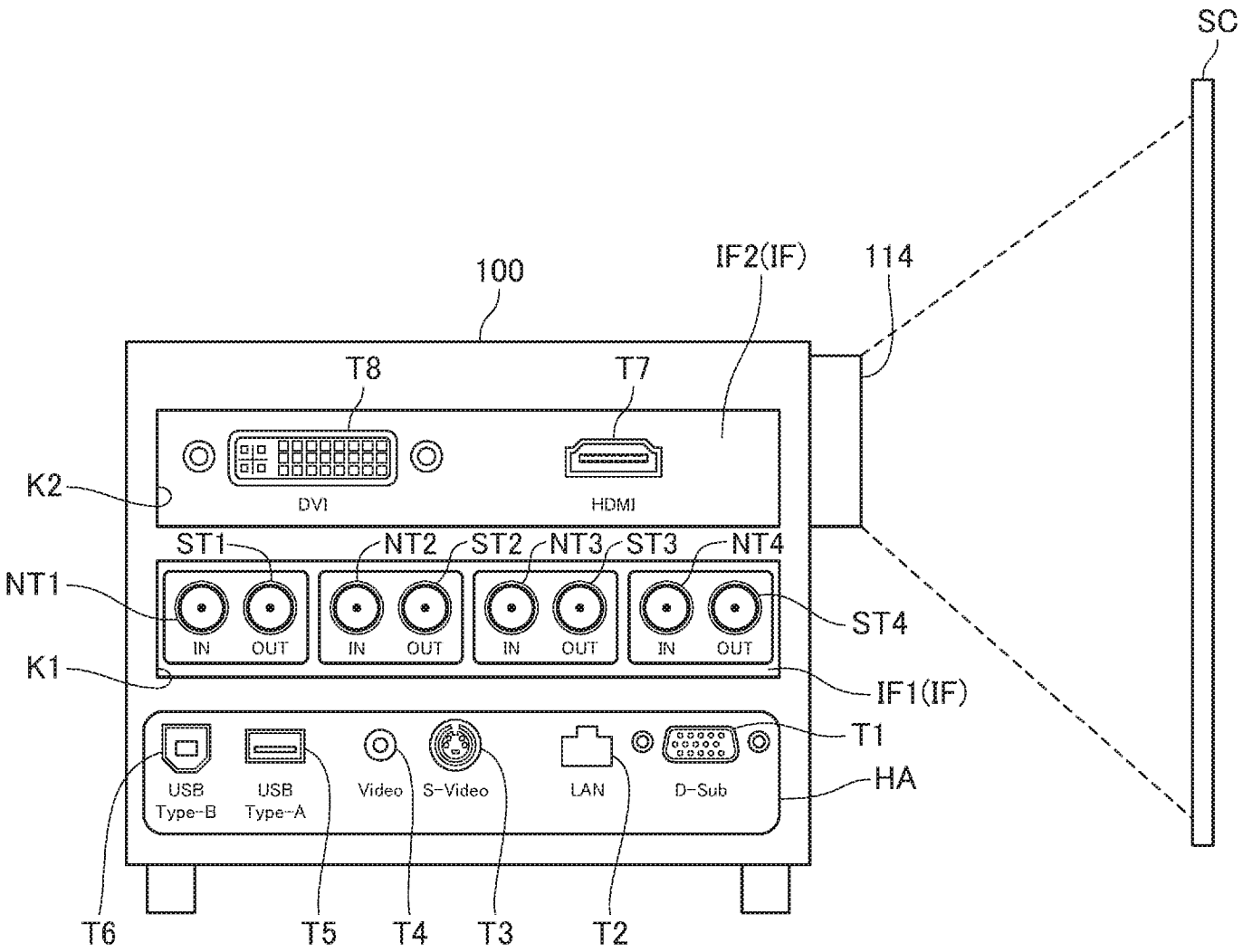
FIG. 1 is a schematic diagram of a projector.

FIG. 1 is a diagram showing a schematic configuration of a projector 100 (a display device).

The projector 100 projects image light on a projection target to form an image based on image information on a surface of the projection target. The projection target on which the projector 100 projects the image can be a flat surface, a curved surface or an uneven surface, and in the present embodiment, there will be illustrated the case of performing the projection on a screen SC formed of a flat surface. A fixed surface such as a wall surface can be used as the screen SC, or the screen SC can be a suspended type or a rising type curtain-like screen. The projector 100 is provided with a projection opening part 114 for projecting the image light. The projection opening part 114 is an opening part through which a projection optical system 113 (see FIG. 2) incorporated in the projector 100 projects light.

On a side surface of a housing of the projector 100, there is formed a terminal placement area HA where input terminals to be included as standard are disposed. In the terminal placement area HA shown in FIG. 1, as the input terminals to be included as standard, there are disposed an input terminal T1 compliant with the D-Sub (D-Subminiature) standard, an input terminal T2 compliant with the LAN (Local Area Network) standard, an input terminal T3 compliant with the S-Video standard, an input terminal T4 compliant with the Video standard, an input terminal T5 compliant with the USB Type-A (Universal Serial Bus Type-A) standard, and an input terminal T6 compliant with the USB Type-B (Universal Serial Bus Type-B) standard.

Further, on a side surface of the housing of the projector 100, there are formed openings K1, K2. The openings K1, K2 are openings for inserting interface boards IF in order to connect the interface boards IF to the projector 100. The interface boards IF are each an expansion board for adding an interface to the projector 100, and each has at least either one of an input terminal and an output terminal compliant with one standard or a plurality of standards. FIG. 1 shows a state in which the interface board IF1 is inserted into the opening K1 to connect the projector 100 and the interface board IF1 to each other. Further, FIG. 1 shows a state in which the interface board IF2 is inserted into the opening K2 to connect the projector 100 and the interface board IF2 to each other.

The interface board IF1 is the interface board IF having input terminals NT1, NT2, NT3 and NT4 compliant with the 3G-SDI standard as one of the SDI (Serial Digital Interface) standards, and output terminals ST1, ST2, ST3 and ST4 compliant with the 3G-SDI standard. It should be noted that the 3G-SDI standard is a standard for making the transmission of data at 3 Gb/s possible with one cable. The interface board IF1 is connected to the projector 100 so as to be able to be displaced with other interface boards IF.

The interface board IF2 is the interface board IF having an input terminal T7 compliant with the HDMI (High-Definition Multimedia Interface) (registered trademark) standard, and an input terminal T8 compliant with the DVI (Digital Visual Interface) standard. The interface board IF2 is connected to the projector 100 so as to be able to be displaced with other interface boards IF.

Although FIG. 1 shows the state in which the interface boards IF1, IF2 are connected to the projector 100, it is also possible to connect the interface boards IF different in type from each other to the projector 100, or to connect the interface boards IF the same in type as each other to the projector 100. The type of the interface board IF differs by the types of the terminals and the number of the terminals provided to the interface board IF.

Since the projector 100 is configured so that the interface boards IF can be connected in a replaceable manner as described above, the advantages described hereinafter are exerted. That is, it is possible for the user to easily set the input terminal provided to the projector 100 to the input terminal compliant with a desired standard only by inserting the interface board IF into the opening to be connected to the projector 100. Further, the projector 100 is not required to have terminals of all of the types. Therefore, it is possible to suppress the cost of the projector 100, and further, there is no need to prepare a space for disposing the terminals of all of the types in the housing.

Figure 2:
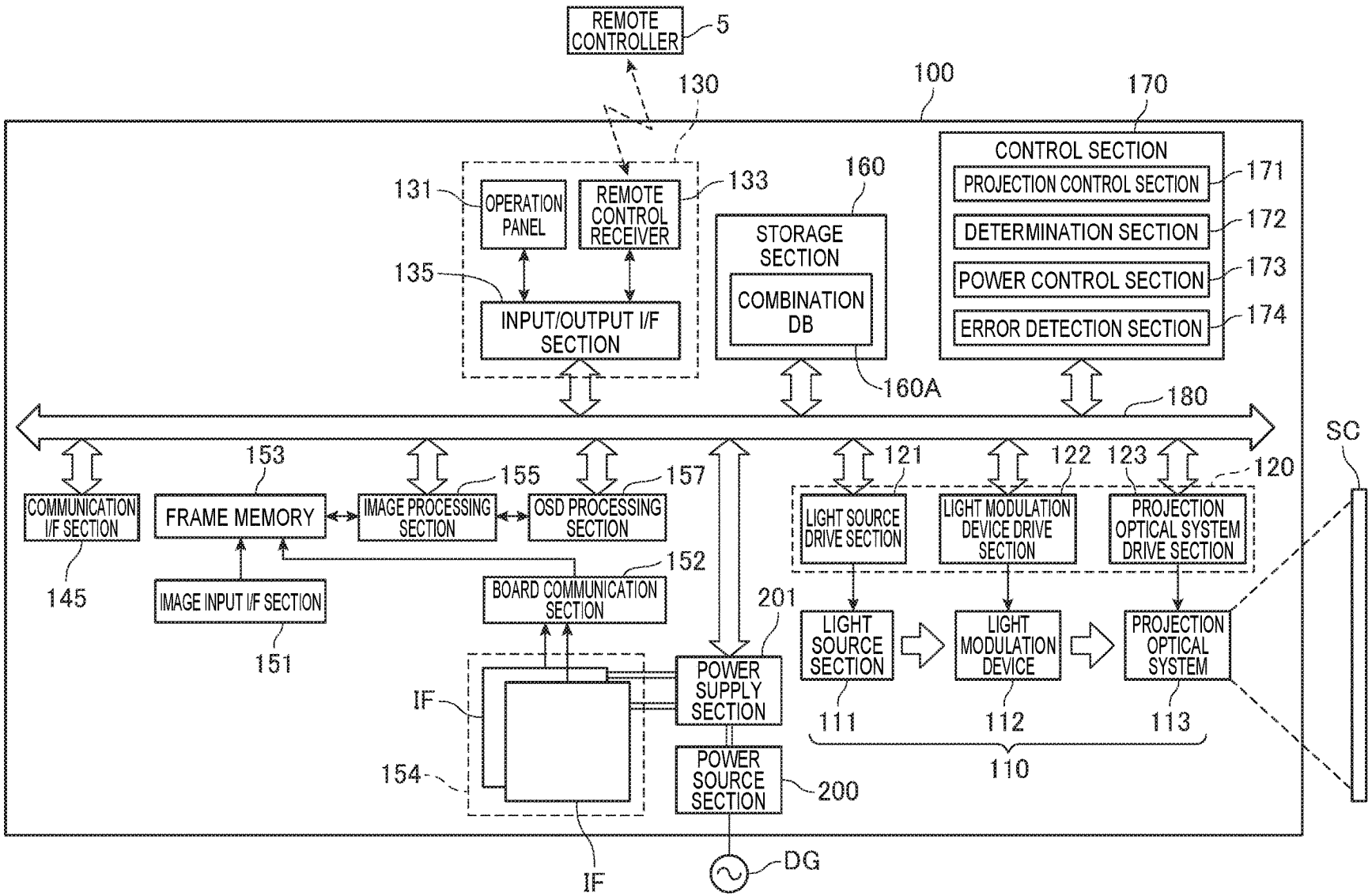
FIG. 2 is a diagram showing a configuration of the projector.

FIG. 2 is a diagram showing a configuration of the projector 100.

The projector 100 is provided with an image input I/F section 151. The image input I/F section 151 is provided with at least the input terminals disposed in the terminal placement area HA, and hardware (e.g., an interface circuit) necessary for the communication via the input terminals. It should be noted that the image input I/F section 151 can also be provided with hardware necessary for the communication compliant with a predetermined wire-less communication standard.

The image input I/F section 151 receives a signal transmitted from the outside. The image input I/F section 151 retrieves image data and sync signals (a vertical sync signal and a horizontal sync signal) included in the signal thus received. The image input I/F section 151 outputs the image data thus retrieved to a frame memory 153 to store the image data into the frame memory 153, and further outputs the sync signals to an image processing section 155 and a control section 170. The image processing section 155 performs a process to the image data in sync with the sync signals. Further, the control section 170 controls an operation of each section constituting the projector 100 based on the sync signals.

A board communication section 152 (a communication section) communicates with the interface boards IF connected to a connection section 154 to receive signals transmitted from the interface boards IF. Further, the board communication section 152 performs extraction of the image data, the sync signals, and so on, output to the frame memory 153, and output of the sync signals similarly to the image input I/F section 151.

The connection section 154 is provided with a configuration capable of connecting the plurality of interface boards IF to the projector 100 in a replaceable manner such as the openings K1, K2. In the present embodiment, the connection section 154 is provided with a configuration capable of connecting the two interface boards IF to the projector 100 at the same time. When the interface board IF is connected, the connection section 154 outputs a signal representing the fact that the interface board IF has been connected to the control section 170. The control section 170 determines presence or absence and the number of the interface boards IF based on the signal input from the connection section 154.

The projector 100 is provided with a projection section 110 for forming an optical image to project the optical image to the screen SC and a drive section 120 for driving the projection section 110. The projection section 110 is provided with a light source section 111, a light modulation device 112, and a projection optical system 113. Further, the drive section 120 is provided with a light source drive section 121, a light modulation device drive section 122, and a projection optical system drive section 123. Here, the projection section 110 corresponds to a "display section" according to the invention.

The light source section 111 is provided with a light source such as a xenon lamp, a super-high pressure mercury lamp, a light emitting diode (LED), or a laser source. Further, the light source section 111 can also be provided with a reflector and an auxiliary reflector for guiding the light emitted by the light source to the light modulation device 112. Further, the light source section 111 can also be provided with a lens group for improving the optical characteristics of the projection light, a polarization plate, a dimming element for reducing the light intensity of the light emitted by the light source on a path leading to the light modulation device 112, and so on (all not shown).

The light source section 111 is driven by a light source drive section 121. The light source drive section 121 is connected to a bus 180, and puts the light source of the light source section 111 on and off in accordance with the control by the control section 170 similarly connected to the bus 180.

The light modulation device 112 is provided with three liquid crystal panels corresponding respectively to, for example, the three primary colors of RGB. The light emitted by the light source section 111 is separated into colored light beams of three colors of RGB, and the colored light beams are made to respectively enter the corresponding liquid crystal panels due to dichroic mirrors, reflecting mirrors, relay lenses and so on (all not shown). The three liquid crystal panels are transmissive liquid crystal panels, and modulate the light beams transmitted through the liquid crystal panels to generate the image light beams, respectively. The image light beams, which have been modulated while passing through the respective liquid crystal panels, are combined by a combining optical system such as a cross dichroic prism, and are then output to the projection optical system 113.

The light modulation device 112 is driven by the light modulation device drive section 122. The light modulation device drive section 122 is connected to the bus 180 to drive the light modulation device 112 in accordance with the control by the control section 170.

The light modulation device drive section 122 generates a drive signal for driving the liquid crystal panel for each of the colors of R, G and B based on the image data input from the image processing section 155. Based on the image signals of R, G, and B thus generated, the light modulation device drive section 122 drives the liquid crystal panels of the corresponding colors to draw the images on the respective liquid crystal panels.

The projection optical system 113 is provided with a lens group for projecting the image light beams which have been modulated by the light modulation devices 112 toward the screen SC to form the image on the screen SC. Further, the projection optical system 113 can also be provided with a zoom mechanism for performing expansion/contraction of the projection image on the screen SC, and a focus adjustment mechanism for performing an adjustment of the focus.

The projection optical system 113 is driven by the projection optical system drive section 123. The projection optical system drive section 123 is provided with, for example, a motor, and drives the motor in accordance with the control by the control section 170 to perform the zoom and the adjustment of the focus.

The projector 100 is provided with an operation receiving section 130. The operation receiving section 130 is provided with an operation panel 131, a remote control receiver 133, and an input/output I/F section 135.

The operation panel 131 functioning as a user interface is provided with a variety of operation keys and a liquid crystal panel. The input/output I/F section 135 is connected to the operation panel 131, the remote control receiver 133, and the bus 180. When the operation key is operated, the input/output I/F section 135 outputs an operation signal corresponding to the operation key thus operated to the control section 170. Further, the input/output I/F section 135 displays a variety of operation screens on the liquid crystal panel in accordance with the control by the control section 170. In the operation screens, there are displayed a variety of buttons capable of operating the projector 100.

The input/output I/F section 135 is connected to the operation panel 131, the remote control receiver 133, and the bus 180. When the operation button is operated, the input/output I/F section 135 outputs an operation signal corresponding to the operation button thus operated to the control section 170.

The remote control receiver 133 for receiving an infrared signal receives an infrared signal transmitted from a remote controller 5 functioning as the user interface. The remote control receiver 133 decodes the infrared signal thus received to generate an operation signal representing the operation content in the remote controller 5, and then outputs the operation signal to the control section 170.

The projector 100 is provided with a communication I/F section 145. The communication I/F 145 transmits and receives a variety of types of data to and from an external device in accordance with a wireless communication standard such as wireless LAN or Blue tooth (a registered trademark) under the control by the control section 170.

The projector 100 is provided with a power source section 200. The power source section 200 is connected to a commercial alternating-current source DG via a cable to generate power for driving the projector 100 based on the power supplied from the commercial alternating-current source DG. Further, the power source section 200 supplies the power thus generated to each section of the projector 100 including a power supply section 201.

The power supply section 201 is connected to the bus 180, and controls the power supply from the power source section 200 to the interface boards IF connected to the connection section 154 in accordance with the control by the control section 170 similarly connected to the bus 180.

The projector 100 is provided with an image processing system. The image processing system is constituted by the control section 170 for performing overall control of the whole of the projector 100 as a central constituent, and is provided with the frame memory 153, the image processing section 155, and a storage section 160 besides the control section 170. The control section 170, the image processing section 155, and the storage section 160 are connected to each other via the bus 180.

The frame memory 153 is provided with a plurality of banks. Each of the banks has a storage capacity sufficient for writing one frame of the image data. The frame memory 153 is formed of, for example, an SDRAM (synchronous dynamic random access memory). The SDRAM is a DRAM which performs reading and writing of the data in sync with a clock.

The image processing section 155 performs processes such as a resolution conversion (scaling) process, a resizing process, correction of a distortion aberration, a shape correction process, a digital zoom process, and an adjustment of the tint and luminance of the image on the image data developed in the frame memory 153. The image processing section 155 performs the process designated by the control section 170, and performs the process using a parameter input from the control section 170 as needed. Further, it is obviously possible for the image processing section 155 to perform two or more of the processes described above in combination with each other.

The image processing section 155 reads out the image data on which the process has been performed from the frame memory 153, and then outputs the image data to an OSD processing section 157.

Based on the control by the control section 170, the OSD processing section 157 performs a process for superimposing OSD menu screens as menu screens for performing a variety of settings on an image represented by the image information input from the image processing section 155. The OSD processing section 157 is provided with an OSD memory not shown, and stores image information representing figures, fonts, and so on for forming the menu image. When the control section 170 instructs the superimposition of the menu image, the OSD processing section 157 reads out the necessary image information from the OSD memory, and then generates the menu image information for forming the menu image designated. Then, the OSD processing section 157 combines the menu image information with the image information input from the image processing section 155 so that the menu image is superimposed at a predetermined position on the image represented by the image information input from the image processing section 155. The combined image information combined with the menu image information is then output to the light modulation device drive section 122. It should be noted that in absence of the instruction from the control section 170 to superimpose the OSD menu screens, the OSD processing section 157 outputs the image information input from the image processing section 155 directly to the light modulation device drive section 122.

The storage section 160 is an auxiliary storage device such as a hard disk drive. The storage section 160 can be replaced with a semiconductor memory such as a flash memory or an EEPROM (electrically erasable programmable ROM), or an optical disc such as a compact disc (CD), a digital versatile disc (DVD), or a Blu-ray (registered trademark) disc (BD). The storage section 160 stores a control program to be executed by the control section 170, and a variety of types of data such as a parameter used for the image processing executed by the image processing section 155. Further, the storage section 160 stores the image data. The projector 100 reads out the image data from the storage section 160 to perform the image processing, and then projects the image data having been processed to the screen SC with the projection section 110.

Further, the storage section 160 stores a combination DB 160A. The combination DB 160A is a database for storing one combination datum or two or more combination data representing combinations of the types of the interface boards IF which cannot be supplied with the power at the same time due to the limitation of the power available to the projector 100 in the case in which the two interface boards IF are connected to the connection section 154 at the same time. In the present embodiment, there is illustrated the case in which the power cannot be supplied to the two interface boards IF1 at the same time. Therefore, the combination DB 160A of the present embodiment stores at least the combination data representing the combination of the types of the interface boards IF1. It should be noted that it is assumed in the present embodiment that the combinations not stored in the storage section 160 are the combinations of the types of the interface boards IF which can be supplied with the power at the same time.

The control section 170 is provided with a CPU, a ROM, a RAM and other peripheral circuits (all not shown) as the hardware. The CPU is a processor for executing arithmetic processing, and executes the arithmetic processing in accordance with the control program stored in the ROM and the storage section 160. The ROM is a nonvolatile memory, and stores, for example, the control program and operation data. The RAM is used as a working area for temporarily storing the control program executed by the processor and the operation data.

In the present embodiment, the control section 170 is provided with one processor (the CPU), and the function of the control section 170 is realized by the processor executing the process according to the control program. However, it is also possible to realize the function of the control section 170 using a plurality of processors or semiconductor chips. For example, it is possible to adopt a configuration in which the control section 170 is further provided with a co-processor such as an SoC (system-on-a-chip), an MCU (micro control unit) or an FPGA (field-programmable gate array). Further, it is also possible for the control section 170 to perform a variety of types of control using both of the CPU and the co-processor cooperating with each other, or selectively using one of the CPU and the co-processor.

The control section 170 is provided with a projection control section 171, a determination section 172, a power control section 173 and an error detection section 174 as functional blocks. These function blocks are the functions which are realized by the CPU executing the arithmetic processing in accordance with the control programs, and are expressed as the blocks in an expedient manner, but do not represent specific application software or hardware.

The projection control section 171 controls the image processing section 155, the OSD processing section 157, the drive section 120 and so on to project the image on the screen SC. Specifically, the projection control section 171 controls the image processing section 155 to make the image processing section 155 process the image data developed in the frame memory 153. On this occasion, the projection control section 171 retrieves the parameter which is necessary for the image processing section 155 to perform the processing from the storage section 160, and then outputs the parameter to the image processing section 155. Further, the projection control section 171 controls the OSD processing section 157 to make the OSD processing section 157 process the image data input from the image processing section 155. In the case in which the operation receiving section 130 has received the operation for displaying the OSD menu screens, the projection control section 171 makes the OSD processing section 157 perform the process for superimposing the OSD menu screens.

Further, the projection control section 171 controls the light source drive section 121 to put the light source of the light source section 111 on, and then control the luminance of the light source thus put on. Further, the projection control section 171 controls the light modulation device drive section 122 to draw the image on the liquid crystal panel of the light modulation device 112. Further, the projection control section 171 controls the projection optical system drive section 123 to drive the motor to control the zoom and the focus of the projection optical system 113.

The determination section 172 determines the type of the interface board IF connected to the connection section 154. For example, the determination section 172 obtains type information representing the type of the interface board IF from the interface board IF, and then performs the determination based on the type information thus obtained.

The power control section 173 controls the power supply section 201 to control the power supply to the interface board IF connected to the connection section 154. In particular, in the case in which the two interface boards IF are connected, the power control section 173 controls the power supply section 201 based on the determination result of the determination section 172 to control the power supply to the two interface boards IF. The power control section 173 switches the power supply state of the power supply section 201 to either one of a concurrent power supply state and a selective power supply state. The concurrent power supply state is the state in which the power is supplied to each of the two interface boards IF connected to the connection section 154. The selective power supply state is the state in which the power is supplied to the interface board IF selected by the user out of the two interface boards IF connected to the connection section 154, and the power is not supplied to the interface board IF not selected by the user.

The error detection section 174 detects an error such as a communication failure with respect to the interface boards IF connected to the connection section 154. As a detection method of the error, any methods can be adopted. The error detection section 174 outputs the detection result to the power control section 173.

Then, the operation of the projector 100 according to the present embodiment will be described.

Figure 3:
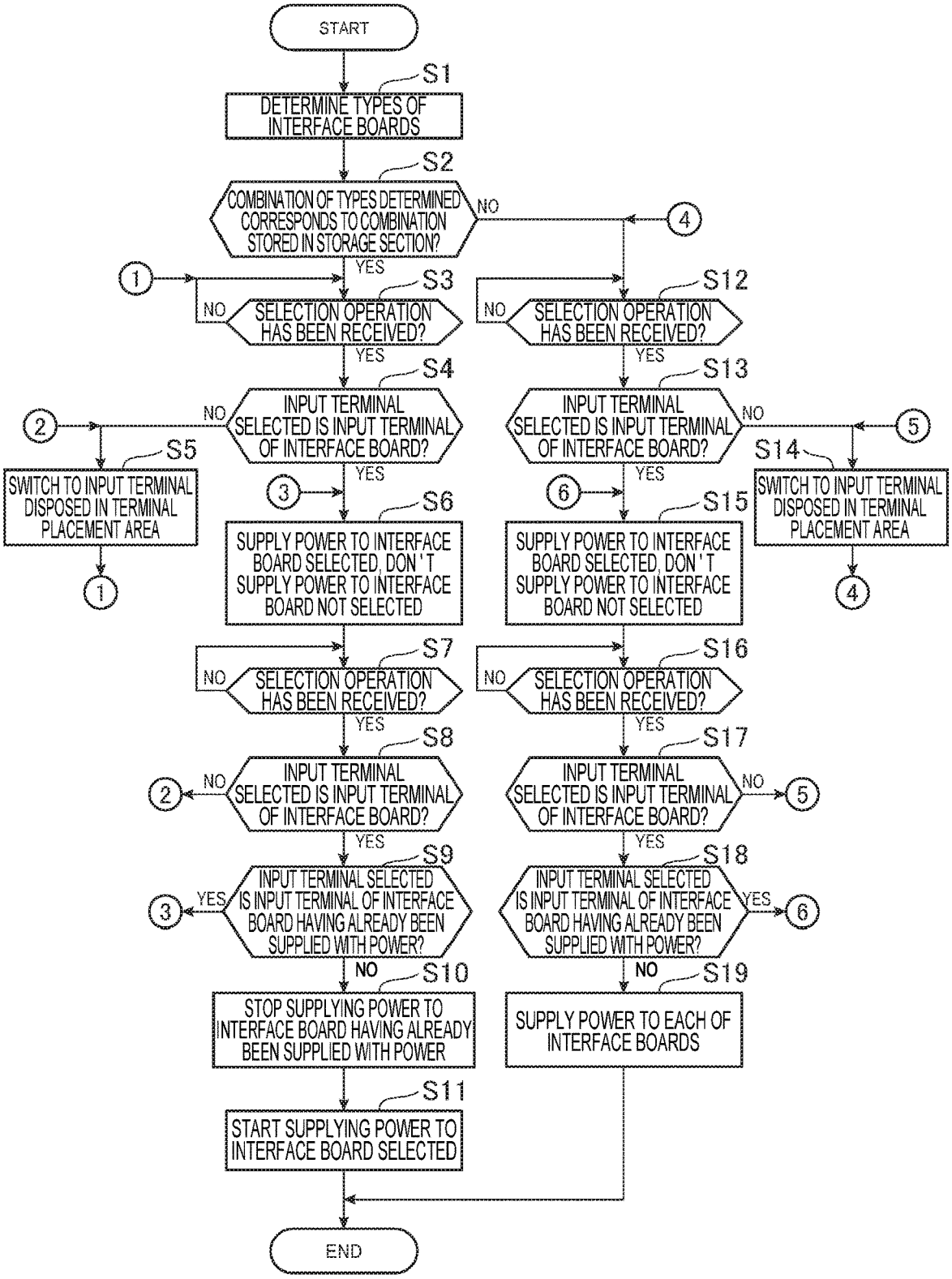
FIG. 3 is a flowchart showing an operation of the projector.

FIG. 3 is a flowchart showing the operation of the projector 100.

In the description of the flowchart shown in FIG. 3, it is assumed that the two interface boards IF are connected to the connection section 154.

The determination section 172 of the control section 170 of the projector 100 determines (step S1) the type of each of the two interface boards IF connected to the connection section 154.

Then, the projection control section 171 determines (step S2) whether or not the combination of the types of the two interface boards IF determined by the determination section 172 corresponds to the combination represented by the combination data stored in the storage section 160.

For example, it is assumed that the interface board IF1 is inserted into each of the opening K1 and the opening K2, and thus, the two interface boards IF1 are connected to the projector 100. In this case, since the combination of the types of the interface boards IF1 is stored in the storage section 160, the projection control section 171 makes an affirmative determination in the step S6.

Further, it is assumed that, for example, the interface board IF1 is inserted into the opening K1, the interface board IF2 is inserted into the opening K2, and thus, the two interface boards IF, namely the interface board IF1 and the interface board IF2, are connected to the projector 100. In this case, since the combination of the types of the interface board IF1 and the interface board IF2 is not stored in the storage section 160, the projection control section 171 makes a negative determination in the step S6.

In the case in which the determination section 172 has determined that the combination of the types of the two interface boards IF determined has corresponded to the combination stored in the storage section 160 (YES in the step S2), the projection control section 171 determines (step S3) whether or not the operation receiving section 130 has received a selection operation for selecting one input terminal in an input switching screen.

The input switching screen is one of the OSD menu screens, and is a screen for the user to select the input terminal from which the image information of the image to be projected is input to switch the input terminal. In the input switching screen, information representing the input terminals to be disposed in the terminal placement area HA, and information representing the input terminals provided to the interface boards IF to be connected to the connection section 154 are displayed in a selectable manner as a table. In the case in which a projection instruction of the input switching screen has been issued by the remote controller 5, the operation panel 131 and so on, the projection control section 171 makes the projection section 110 project the input switching screen.

In the case in which the projection control section 171 has determined that the operation receiving section 130 has received the selection operation (YES in the step S3), the projection control section 171 determines (step S4) whether or not the input terminal having been selected in the input switching screen is the input terminal of the interface board IF connected to the connection section 154.

In the case in which the projection control section 171 has determined that the input terminal selected is not the input terminal of the interface board IF connected to the connection section 154 (NO in the step S4), the projection control section 171 switches (step S5) the input terminal from which the image information of the image to be projected is input to other input terminals than the input terminal of the interface board IF. The input terminals other than the input terminal of the interface board IF are the input terminals disposed in the terminal placement area HA.

Returning to the description of the step S3, in the case in which it has been determined that the input terminal having been selected in the input switching screen is the input terminal of the interface board IF connected to the connection section 154 (YES in the step S4), the power control section 173 supplies the power to the interface board IF having the input terminal having been selected by the selection operation, but does not supply the power to the interface board IF having not been selected (step S6).

For example, it is assumed that the interface board IF1 is inserted in each of the opening K1 and the opening K2, and thus, the two interface boards IF1 are connected to the projector 100. In this case, if anyone of the input terminals NT1, NT2, NT3 and NT4 provided to the interface board IF1 inserted in the opening K1 is selected by the selection operation in the input switching screen, the power control section 173 supplies the power to the interface board IF1 inserted in the opening K1, but does not supply the power to the interface board IF1 inserted in the opening K2. Thus, it is possible for the power control section 173 to supply the sufficient power to the interface board IF1 inserted in the opening K1. Therefore, it is possible for the power control section 173 to make it possible for the user to use the interface board IF1 inserted in the opening K1.

Then, the control section 171 determines (step S8) whether or not the operation receiving section 130 has received the selection operation of selecting one input terminal in the input switching screen. In the case in which a projection instruction of the input switching screen has been issued by the remote controller 5, the operation panel 131 and so on, the projection control section 171 makes the projection section 110 project the input switching screen.

In the case in which the projection control section 171 has determined that the operation receiving section 130 has received the selection operation (YES in the step S7), the projection control section 171 determines (step S8) whether or not the input terminal having been selected in the input switching screen is the input terminal of the interface board IF connected to the connection section 154.

In the case in which the projection control section 171 has determined that the input terminal having been selected by the selection operation is not the input terminal of the interface board IF connected to the connection section 154 (NO in the step S8), the projection control section 171 makes the transition of the process to the step S5 to switch (step S5) the input terminal from which the image information of the image to be projected is input from the input terminal of the interface board IF to the input terminal disposed in the terminal placement area HA. It should be noted that during the switching operation, it is preferable for the power control section 173 to stop supplying the power to the interface board IF to which the power has been supplied before the switching operation in order to suppress the power consumption.

In contrast, in the case in which it has been determined that the input terminal having been selected in the input switching screen is the input terminal of the interface board IF (YES in the step S8), the projection control section 171 determines (step S9) whether or not the input terminal having been selected in the input switching screen is the input terminal of the interface board IF having already been supplied with the power.

In the case in which it has been determined that the input terminal thus selected is not the input terminal of the interface board IF having already been supplied with the power (NO in the step S9), the power control section 173 stops (step S10) supplying the power to the interface board IF to which the power has already been supplied. Then, the power control section 173 starts (step S11) supplying the power to the interface board IF having the input terminal having been selected in the step S7.

For example, it is assumed that the interface board IF1 is inserted in each of the opening K1 and the opening K2, and thus, the two interface boards IF1 are connected to the projector 100. Further, it is assumed that the power is supplied to the interface board IF1 inserted in the opening K1, but the power is not supplied to the interface board IF1 inserted in the opening K2. In this case, when the input terminal of the interface board IF1 inserted in the opening K2 is selected in the input switching screen, the power control section 173 firstly stops supplying the power to the interface board IF1 inserted in the opening K1. Then, subsequently, the power control section 173 starts supplying the power to the interface board IF1 inserted in the opening K2.

In this example, the interface board IF1 inserted in the opening K1 corresponds to a "first interface board" according to the invention. Further, the interface board IF1 inserted in the opening K2 corresponds to a "second interface board" according to the invention.

Thus, it is possible for the power control section 173 to supply the sufficient power to the interface board IF1 inserted in the opening K2. Therefore, in the case in which the user switches the interface board IF used from the interface board IF1 inserted in the opening K1 to the interface board IF1 inserted in the opening K2, it is possible for the user to surely use the interface board IF inserted in the opening K2. In particular, even in the case in which the two interface boards IF to which the power cannot concurrently be supplied like the interface boards IF1 are connected, the sufficient power can be supplied, and therefore, it is possible to make it possible to surely use the interface board IF the user has selected.

Returning to the description of the step S2, in the case in which it has been determined that the combination of the types of the two interface boards IF does not correspond to the combination stored in the storage section 160 (NO in the step S2), the control section 170 performs the process of the steps S12, S13, S14, S15, S16, S17 and S18. The process from the step S12 to the step S18 is substantially the same process as the process from the step S3 to the step S9, and therefore, the detailed description will be omitted.

The projection control section 171 determines (step S18) whether or not the input terminal having been selected by the selection operation having been received by the operation receiving section 130 in the step S16 is the input terminal of the interface board IF having already been supplied with the power. In the case in which it has been determined that the input terminal thus selected is the input terminal of the interface board IF having already been supplied with the power (YES in the step S18), the power control section 173 supplies (step S19) the power to each of the two interface boards IF.

It is assumed that, for example, the interface board IF1 is inserted in the opening K1, the interface board IF2 is inserted in the opening K2, and thus, the interface board IF1 and the interface board IF2 are connected to the projector 100. Further, it is assumed that the power is supplied to the interface board IF1 inserted in the opening K1, but the power is not supplied to the interface board IF2 inserted in the opening K2. In this case, when the input terminal of the interface board IF2 inserted in the opening K2 is selected in the input switching screen, the power control section 173 supplies the power to each of the interface boards IF1, IF2 without stopping the supply of the power to the interface board IF1.

In this example, the interface board IF1 inserted in the opening K1 corresponds to the "first interface board" according to the invention. Further, the interface board IF2 inserted in the opening K2 corresponds to the "second interface board" according to the invention.

In the present embodiment, since there is illustrated the case in which the two interface boards IF1 cannot concurrently be supplied with the power, the combination of the interface board IF1 and the interface board IF2 is the combination to which the power is concurrently supplied. Therefore, in the case in which the two interface boards IF to which the power can concurrently be supplied are connected, the power control section 173 supplies the power to each of the interface boards IF based on the selection operation by the user. Thus, in the case in which the two interface boards IF which can concurrently be supplied with the power are connected, it is possible for the power control section 173 to make it possible to use the two interface boards IF including the interface board IF selected by the user. Therefore, for example, it becomes possible for the projection control section 171 to make the projection section 110 project the image based on the image information obtained by combining the image information input from the interface board IF inserted in the opening K1 and the image information input from the interface board IF inserted in the opening K2 with each other.

It should be noted that in the above description, there is explained the configuration in which the power is supplied to the interface board IF due to the selection of the input terminal on the input switching screen in the case in which it has been determined that the combination of the types of the two interface boards IF does not correspond to the combination stored in the storage section 160. However, it is also possible to adopt a configuration in which the power is supplied to both of the interface boards IF in the stage in which it has been determined that the combination of the types of the two interface boards IF does not correspond to the combination stored in the storage section 160.

Modified Example

Then, a modified example will be described.

In the modified example, the operation of the projector 100 described above is different.

Figure 4:
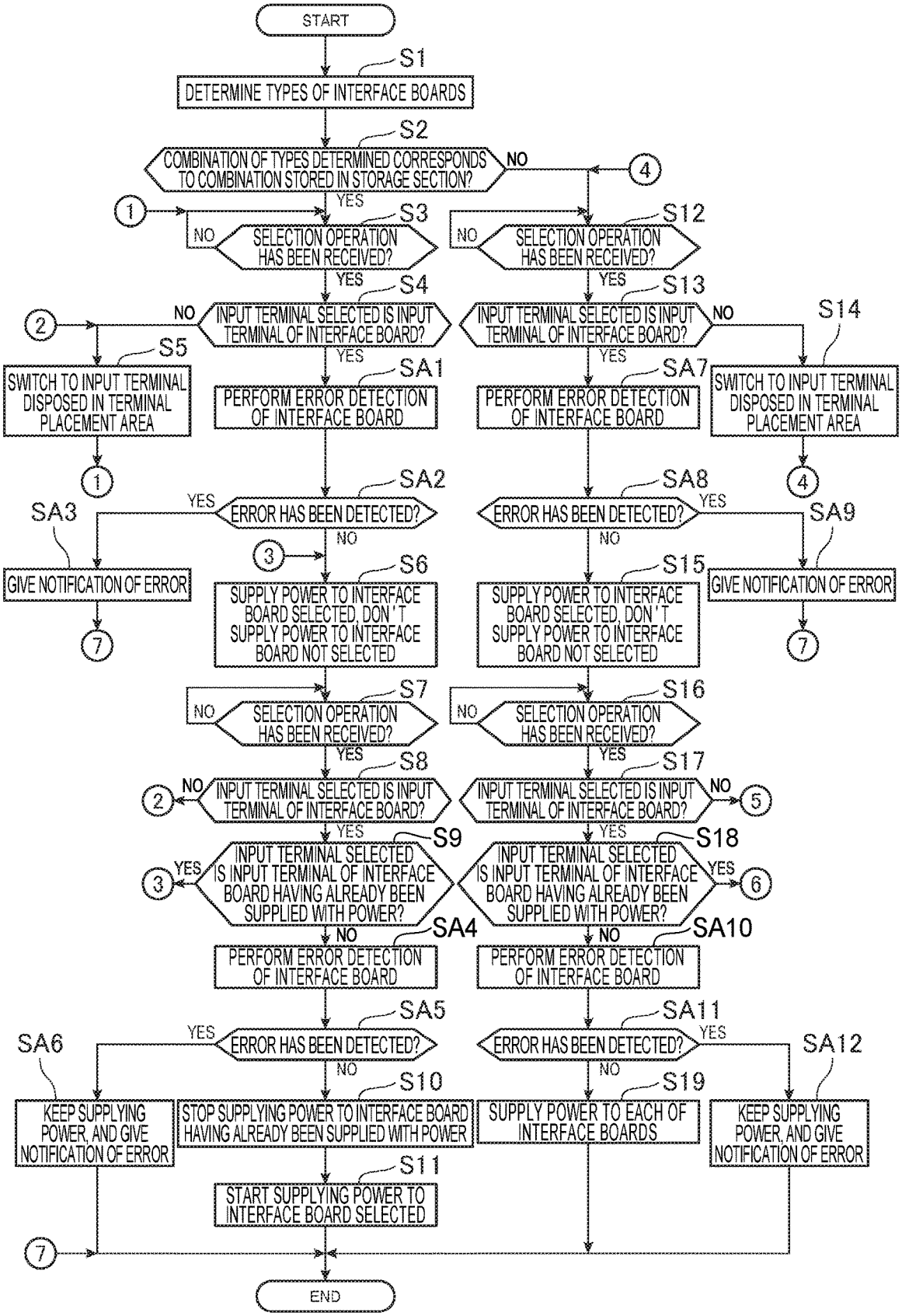
FIG. 4 is a flowchart showing an operation of the projector.

FIG. 4 is a flowchart showing the operation of the projector 100 according to the modified example.

In the flowchart shown in FIG. 4, the same steps as those of the flowchart shown in FIG. 3 are denoted by the same step numbers, and the detailed description of the process thereof will be omitted.

In the description of the flowchart shown in FIG. 4, it is assumed that the two interface boards IF are connected to the connection section 154.

In the case in which the projection control section 171 has determined that the input terminal selected by the selection operation in the input switching screen is the input terminal of the interface board IF connected to the connection section 154 (YES in the step S4), the error detection section 174 performs (step SA1) the error detection on the interface board IF having the input terminal selected by the selection operation.

Then, the power control section 173 determines (step SA2) whether or not the error detection section 174 has detected the error. In the case in which the power control section 173 has determined that the error detection section 174 has not detected the error (NO in the step SA2), the power control section 173 supplies the power to the interface board IF having the input terminal selected by the selection operation, but does not supply the power to the interface board IF not selected (step S6).

In contrast, in the case in which the power control section 173 has determined that the error detection section 174 has detected the error (YES in the step SA2), the power control section 173 notifies (step SA3) the user of the error of the interface board IF detected by the error detection section 174. For example, the power control section 173 makes the projection section 110 project an image related to the error such as the fact that the error has occurred or a content of the error to thereby notify the user of the error detected by the error detection section 174. In this case, the projection section 110 corresponds to a "notification section" according to the invention. It should be noted that the configuration of the notification is not limited to the projection by the projection section 110, but can also be a configuration such as display using the liquid crystal panel. By giving the notification of the error in such a manner, it is possible for the user to recognize the fact that the error has been detected in the interface board IF selected.

It should be noted that in the step SA3, it is also possible for the power control section 173 to supply the power to the interface board IF the user has not selected using the selection operation. The step SA3 corresponds to the process of the case in which the two interface boards IF which cannot concurrently be supplied with the power are connected, and in the present embodiment, corresponds to the process of the case in which the two interface boards IF1 are connected. In such a connection configuration, if the error has been detected in the interface board IF having been selected, there is a high probability that the user selects another interface board IF the same in type in the input switching screen. Therefore, it is possible for the projection control section 171 to automatically make it possible for the user to use another interface board IF the same in type by supplying the power to the interface board IF the same in type which the user has not selected.

In the step S9, the projection control section 171 determines whether or not the input terminal having been selected in the input switching screen is the input terminal of the interface board IF having already been supplied with the power. In the case in which it has been determined that the input terminal thus selected is the input terminal of the interface board IF having already been supplied with the power (YES in the step S9), the error detection section 174 performs (step SA4) the error detection on the interface board IF having the input terminal selected by the selection operation in the step S7. In the step SA4, the interface board IF to be the target of the error detection is the interface board IF not supplied with the power.

Then, the power control section 173 determines (step SA5) whether or not the error detection section 174 has detected the error. In the case in which the power control section 173 has determined that the error detection section 174 has not detected the error (NO in the step SA5), the power control section 173 stops (step S10) supplying the power to the interface board IF having already been supplied with the power. Then, the power control section 173 starts (step S11) supplying the power to the interface board IF having the input terminal having been selected in the step S7.

In contrast, in the case in which the power control section 173 has determined that the error detection section 174 has detected the error (YES in the step SA5), the power control section 173 keeps supplying the power to the interface board IF having already been supplied with the power, and notifies (step SA6) the user of the error of the interface board IF selected by the selection operation. Since the power control section 173 keeps supplying the power to the interface board IF having already been supplied with the power as described above, the power control section 173 does not supply the power to the interface board IF in which the error has been detected. Therefore, it is possible for the power control section 173 to prevent the error thus detected from further expanding due to the supply of the power. Further, by giving the notification of the error, it is possible for the user to recognize the fact that the error has been detected in the interface board IF selected.

The step SA7 and the step SA1 correspond to substantially the same process, the step SA8 and the step SA2 correspond to substantially the same process, and the step SA9 and the step SA3 correspond to substantially the same process. Therefore, the detailed descriptions of the steps SA7, SA8 and SA9 will be omitted.

The step SA10 and the step SA4 correspond to substantially the same process, the step SA11 and the step SA5 correspond to substantially the same process, and the step SA12 and the step SA6 correspond to substantially the same process. Therefore, the detailed descriptions of the steps SA10, SA11 and SA12 will be omitted.

As described hereinabove, the projector 100 (the display device) is provided with the connection section 154 to which the two interface boards IF can be connected in a replaceable manner, the board communication section 152 (the communication section) for performing the communication with the interface boards IF connected to the connection section 154, the determination section 172 for determining the types of the interface boards connected to the connection section 154, the power control section 173 for controlling the supply of the power to the interface boards IF connected to the connection section 154, the operation receiving section 130 for receiving the selection operation for selecting either of the interface boards IF connected to the connection section 154, and the projection section 110 (the display section) for projecting the image based on the image information input from the interface board IF selected by the selection operation to the board communication section 152.

In the state in which the power control section 173 supplies the power to one interface board IF (a first interface board) but does not supply the power to the other interface board IF (a second interface board) based on the types of the two interface boards IF determined by the determination section 172, when the operation receiving section 130 receives the selection operation for selecting the other interface board IF, the power control section 173 stops supplying the power to the one interface board IF, and then starts supplying the power to the other interface board IF after stopping the supply of the power to the one interface board IF.

According to this configuration, since the sufficient power can be supplied to the interface board IF selected, it is possible to make it possible to surely use the interface board IF selected by the user in the projector 100 to which the two interface boards IF can be connected in a replaceable manner.

Further, the projector 100 is provided with the storage section 160 for storing the combination of the types of the interface boards IF which cannot concurrently be supplied with the power. In the case in which the combination of the types of the two interface boards IF determined by the determination section 172 corresponds to the combination stored in the storage section 160, the power control section 173 supplies the power to the interface board IF selected by the selection operation, and does not supply the power to the other interface board IF corresponding to the combination stored in the storage section 160.

According to this configuration, even in the case in which the two interface boards IF which cannot concurrently be supplied with the power are connected, it is possible to supply the sufficient power to the interface board IF selected. Therefore, it is possible for the projector 100 to make it possible to use the interface board IF selected by the user even in the case in which the two interface boards IF which cannot concurrently be supplied with the power are connected.

Further, in the case in which the combination of the types of the plurality of interface boards IF determined by the determination section 172 does not correspond to the combination stored in the storage section 160, the power control section 173 supplies the power to each of the two interface boards IF connected to the connection section 154.

According to this configuration, in the case in which the two interface boards IF which can concurrently be supplied with the power are connected, it is possible to supply the sufficient power to the two interface boards IF including the interface board IF selected. Therefore, it is possible for the projector 100 to make it possible for the user to use the two interface boards IF including the interface board IF selected.

Further, the projector 100 is provided with the error detection section 174 for detecting the error of the interface board IF selected by the selection operation. In the state in which the power control section 173 supplies the power to one interface board IF of the two interface boards IF and does not supply the power to the other interface board IF, in the case in which the error detection section 174 has detected the error in the other interface board IF selected by the selection operation, the power control section 173 keeps supplying the power to the one interface board IF and makes the projection section 110 give notification of the error detected by the error detection section 174.

According to this configuration, it is possible to make the user recognize the error detected in the interface board IF while preventing the expansion of the error detected in the interface board IF selected by the selection operation.

The embodiment and the modified example described above are each a preferred embodiment of the invention. It should be noted that the invention is not limited to the embodiment and the modified example, but can be implemented with a variety of modifications within the scope or the spirit of the invention.

For example, although the case in which the number of the interface boards IF which can be connected to the connection section 154 is two is explained in the embodiment and the modified example described above, the number is not particularly limited as long as the number is more than one. In this case, in the side surface of the housing of the projector 100, there are formed the corresponding number of openings to the number of the interface boards IF which can be connected.

Further, for example, in the embodiment and the modified example described above, there is illustrated the combination of the types of the interface boards IF1 each having the input terminal and the output terminal compliant with the 3G-SDI standard as the combination of the types of the interface boards IF which cannot concurrently be supplied with the power. However, the combination of the types of the interface boards IF which cannot concurrently be supplied with the power is not limited to this combination, but can be any combinations of the types of the interface boards IF the total power of which necessary for the interface boards IF to operate exceeds the power which can be supplied from the projector 100 when concurrently supplying the power.

For example, in the embodiment described above, there is described the case in which the projector 100 is a liquid crystal projector using the transmissive liquid crystal panels, but it is also possible to adopt a projector using reflective liquid crystal panels or digital mirror devices.

Further, in the case in which, for example, the method (the method of controlling the display device) of controlling the projector 100 is realized using a computer provided to the projector 100, or an external device connected to the projector 100, it is also possible to configure the invention as an aspect of a program executed by the computer for realizing the method, a recording medium storing the program in a computer-readable manner, or a transmission medium for transmitting the program.

Further, the processing units of the flowcharts shown in FIG. 3 and FIG. 4 are obtained by dividing the process of the control section 170 of the projector 100 in accordance with major processing contents in order to make the process of the control section 170 easy to understand. The scope of the invention is not limited by the way of the division or the names of the processing units shown in the flowcharts of FIG. 3 and FIG. 4. Further, the process of the control section 170 can also be divided into a larger number of processing units, or can also be divided so that one processing unit includes a larger amount of process in accordance with the processing contents. Further, the processing sequence of the flowcharts described above is not limited to the examples shown in the drawings.

Further, each of the functional sections of the projector 100 shown in FIG. 2 is for showing the functional configuration realized by the cooperation of the hardware and the software, and the specific installation configuration is not particularly limited. Therefore, it is not necessarily required to install the hardware corresponding individually to each of the functional sections, but it is obviously possible to adopt a configuration of realizing the functions of the plurality of functional sections by a single processor executing a program. Further, apart of the function realized by the software in the embodiment described above can also be realized by the hardware, or a part of the function realized by the hardware can also be realized by the software.

Further, the display device according to the invention is not limited to the projector for projecting an image on the screen SC. For example, regarding the display device, a variety of display devices such as a liquid crystal monitor or a liquid crystal television set for displaying images on a liquid crystal panel, a monitor device or a television receiver for displaying images on a plasma display panel (PDP), or a light emitting display device such as a monitor device or a television receiver for displaying images on an organic EL display panel called an organic light-emitting diode (OLED), an organic electroluminescence (OEL) and so on are also included in the display device according to the invention.

What is claimed is:

1. A display device comprising:

a connection section to which a plurality of interface boards can be connected in a replaceable manner;

a communication section adapted to communicate with the interface boards connected to the connection section;

one or more processors configured to function as a determination section that determines a type of the interface boards connected to the connection section, and as a power control section that controls supply of power to the interface boards connected to the connection section;

an operation receiving section adapted to receive a selection operation adapted to select any of the interface boards connected to the connection section;

a display section adapted to display an image based on image information input from the interface board selected by the selection operation to the communication section; and a memory that stores a combination of the types of the interface boards which cannot concurrently be supplied with the power, wherein in a state in which the power control section supplies the power to a first interface board connected to the connection section but does not supply the power to a second interface board based on the types of the plurality of interface boards determined by the determination section, when the operation receiving section receives the selection operation of selecting the second interface board, the power control section stops supplying the power to the first interface board, and then starts supplying the power to the second interface board after stopping the supply of the power to the first interface boards, and wherein in a case in which the combination of the types of the plurality of interface boards determined by the determination section corresponds to the combination stored in the storage section, the power control section supplies the power to the interface board selected by the selection operation, and does not supply the power to other interface boards corresponding to the combination stored in the storage section.

2. The display device according to claim 1, wherein in a case in which the combination of the types of the plurality of interface boards determined by the determination section fails to correspond to the combination stored in the storage section, the power control section supplies the power to each of the plurality of interface boards connected to the connection section.

3. A display device comprising:

a connection section to which a plurality of interface boards can be connected in a replaceable manner;

a communication section adapted to communicate with the interface boards connected to the connection section;

one or more processors configured to function as a determination section that determines a type of the interface boards connected to the connection section, as an error detection section that detects an error of the interface board selected by the selection operation, and as a power control section that controls supply of power to the interface boards connected to the connection section;

an operation receiving section adapted to receive a selection operation adapted to select any of the interface boards connected to the connection section;

a display section adapted to display an image based on image information input from the interface board selected by the selection operation to the communication section; and a notification section, wherein in a state in which the power control section supplies the power to a first interface board connected to the connection section but does not supply the power to a second interface board based on the types of the plurality of interface boards determined by the determination section, when the operation receiving section receives the selection operation of selecting the second interface board, the power control section stops supplying the power to the first interface board, and then starts supplying the power to the second interface board after stopping the supply of the power to the first interface boards, and wherein in a state in which the power control section supplies the power to the first interface board connected to the connection section, but does not supply the power to the second interface board, in a case in which the error detection section has detected the error in the second interface board selected by the selection operation, the power control section keeps supplying the power to the first interface board and makes the notification section give notification of the error detected by the error detection section.

4. A method of controlling a display device including a connection section to which a plurality of interface boards can be connected in a replaceable manner, an operation receiving section adapted to receive a selection operation adapted to select any of the interface boards connected to the connection section, and a display section adapted to display an image based on image information input from the interface board selected by the selection operation, and a memory that stores a combination of the types of the interface boards which cannot concurrently be supplied with the power, the method comprising:

determining a type of the interface board connected to the connection section;

stopping supply of power to a first interface board in a case of receiving the selection operation of selecting a second interface board in a state in which the power is supplied to the first interface board connected to the connection section but the power is not supplied to the second interface board based on the types of the plurality of interface boards determined, and then starting supply of the power to the second interface board after stopping the supply of the power to the first interface board; and in a case in which the combination of the types of the plurality of interface boards determined by the determination section corresponds to the combination stored in the storage section, supplying the power to the interface board selected by the selection operation, and does not supply the power to other interface boards corresponding to the combination stored in the storage section.

5. A method of controlling a display device including a connection section to which a plurality of interface boards can be connected in a replaceable manner, an operation receiving section adapted to receive a selection operation adapted to select any of the interface boards connected to the connection section, a display section adapted to display an image based on image information input from the interface board selected by the selection operation, and a notification section, the method comprising:

detecting an error of the interface board selected by the selection operation;

determining a type of the interface board connected to the connection section;

stopping supply of power to a first interface board in a case of receiving the selection operation of selecting a second interface board in a state in which the power is supplied to the first interface board connected to the connection section but the power is not supplied to the second interface board based on the types of the plurality of interface boards determined, and then starting supply of the power to the second interface board after stopping the supply of the power to the first interface board; and in a state in which the power control selection supplies the power to the first interface board connected to the connection section, but does not supply the power to the second interface board, in a case in which an error has been detected in the second interface board selected by the selection operation, keeping supplying the power to the first interface board and making the notification section give notification of the error.

* * * * *